US009533316B2

(12) United States Patent
Zumberger et al.

(10) Patent No.: US 9,533,316 B2
(45) Date of Patent: Jan. 3, 2017

(54) SPRAY GUN WITH AIR HALO NOZZLE ASSEMBLY

(71) Applicant: Stolle Machinery Company, LLC, Centennial, CO (US)

(72) Inventors: Neil A. Zumberger, Sidney, OH (US); Michael A. Thomas, Houston, OH (US); Andrew T. Hogenkamp, Dayton, OH (US); Jeremiah R. Zimmerman, Sidney, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 0 days.

(21) Appl. No.: 14/674,468

(22) Filed: Mar. 31, 2015

(65) Prior Publication Data

US 2016/0288145 A1 Oct. 6, 2016

(51) Int. Cl.

| | |
|---|---|
| ***B05B 1/28*** | (2006.01) |
| ***B05B 7/06*** | (2006.01) |
| ***B05B 7/08*** | (2006.01) |
| ***B05B 12/06*** | (2006.01) |
| ***B05B 1/08*** | (2006.01) |
| ***B05B 7/10*** | (2006.01) |
| ***B05B 15/04*** | (2006.01) |

(52) U.S. Cl.

CPC ..... *B05B 7/066* (2013.01); *B05B 1/083* (2013.01); *B05B 7/0815* (2013.01); *B05B 7/10* (2013.01); *B05B 12/06* (2013.01); *B05B 15/0431* (2013.01)

(58) Field of Classification Search

CPC ..... B05B 7/0815; B05B 7/066; B05B 7/10; B05B 15/0431; B05B 1/083; B05B 12/06

USPC ..... 239/290, 296, 298, 423, 424, 99, 101,239/105

See application file for complete search history.

(56) References Cited

U.S. PATENT DOCUMENTS

| | | | | |
|---|---|---|---|---|
| 6,325,853 | B1 * | 12/2001 | Hogan | B05B 7/0861 239/298 |
| 7,320,436 | B2 * | 1/2008 | Runeman | B05B 7/0815 239/290 |
| 7,622,002 | B2 | 11/2009 | McEldowney et al. | |
| 7,886,989 | B2 * | 2/2011 | Saidman | B05C 5/027 239/101 |
| 8,113,445 | B2 | 2/2012 | Drozd | |
| 8,826,850 | B2 | 9/2014 | Zumberger et al. | |

(Continued)

OTHER PUBLICATIONS

Stolle Machinery Company, LLC, PCT/US16/15005 Search Report, Apr. 8, 2016, 10 pages.

*Primary Examiner* — Steven J Ganey
(74) *Attorney, Agent, or Firm* — Eckert Seamans Cherin & Mellott, LLC; David C. Jenkins

(57) ABSTRACT

An air halo assembly for a spray gun assembly is provided. The spray gun assembly includes a fluid supply assembly, an air supply assembly, and an air halo nozzle assembly. The air halo nozzle assembly includes a liquid nozzle assembly and an air halo assembly. The fluid supply assembly is coupled to, and is in fluid communication with, the liquid nozzle assembly. The air halo nozzle assembly is structured to produce a liquid flow stream having a longitudinal axis. The air halo assembly includes a body. The air halo assembly body defines a passage. The air halo assembly body passage includes an inlet and an air halo outlet. The air halo assembly body passage inlet is structured to be in fluid communication with the air supply assembly.

18 Claims, 3 Drawing Sheets

(56) References Cited

U.S. PATENT DOCUMENTS

| | | | | |
|---|---|---|---|---|
| 2004/0164180 | A1* | 8/2004 | Harris | B05B 7/0861 239/296 |
| 2006/0102234 | A1 | 5/2006 | Meisel | |
| 2014/0338595 | A1 | 11/2014 | Zumberger et al. | |
| 2015/0069142 | A1 | 3/2015 | Duncan et al. | |

* cited by examiner

SPRAY GUN WITH AIR HALO NOZZLE ASSEMBLY

BACKGROUND OF THE INVENTION

Field of the Invention

The disclosed and claimed concept relates to a spray gun system utilizing a nozzle structured to dispense liquids, i.e. spray a liquid, and, more specifically, to a spray gun system including an air halo nozzle assembly for providing a gaseous barrier extending about a liquid flow stream.

Background Information

Certain fluid dispensing systems are structured to dispense a liquid such as, but not limited to, a sealant or an adhesive onto a substrate. The remainder of this description shall use an adhesive as an example, but it is understood that the liquid is not limited to an adhesive. Such liquid dispensing systems may utilize nozzle assemblies, or "spray guns" that are closed by an internal needle. Generally, an adhesive is either a solvent-based adhesive or a water-based adhesive. In some aspects, the spray gun is adapted to a specific type of adhesive. For example, a solvent-based system will include a temperature control to maintain the temperature of the liquid.

The spray gun includes a housing that defines a chamber with an exhaust passage, that is, a nozzle. The chamber includes a liquid inlet and may contain a liquid outlet. The liquid flows into the chamber via the liquid inlet. The liquid may be stored, briefly, in the chamber before application. For a water-based adhesive, the liquid is, typically, expelled exclusively via the nozzle. For a solvent based adhesive, a portion of the liquid may be dispensed via the nozzle and any excess liquid that may be recycled exits the chamber via the outlet. The liquid may then be drained from the system, or, reheated and re-circulated.

The nozzle defines an internal, elongated passage having a generally frusto-conical shape, i.e. a frustum. The nozzle further includes an internal seat; the seat may be part of the internal surface of the nozzle. A needle having its longitudinal axis aligned with the axis of the nozzle passage is used to seal the passage; that is, the needle coupled to an actuator structured to move the needle in an axial direction; i.e. longitudinally. The needle proximal end is coupled to the actuator and the opposite end of the needle distal tip is shaped generally, or substantially, to correspond to the shape of the nozzle seat. When the needle is in a forward, first position, the needle distal tip sealingly engages the nozzle seat. In this configuration, the spray gun is closed. When the needle is in a retracted, second position, the needle distal tip is fully spaced from the nozzle seat. In this configuration, the spray gun is open. Further, and as described below, the needle may also be placed anywhere between the first and second position, thereby causing the nozzle to be partially open. That is, when the needle is in the second position, i.e. fully spaced from the nozzle internal passage, the nozzle is, essentially, unblocked and allows for the nozzle's maximum flow rate. It is noted that, while in the second position, the needle may be disposed within the nozzle internal passage, so long as the nozzle achieves its maximum intended flow rate. If the needle is somewhere between the first and second positions, the nozzle is partially open and the liquid flows at a rate less than the maximum flow rate. Any time the nozzle is open, or partially open, the liquid forms a stream, or spray, between the nozzle and substrate. As used herein, the emerging liquid product is identified as a "flow stream."

Typically, such spray guns must be opened and closed both rapidly and intermittently. That is, the nozzle is cyclically opened a brief period of time, then closed for a brief period of time. This would allow, for example, a quantity of sealant to be applied to an object while the spray gun is open, then for the object to be moved and replaced while the spray gun is closed. This is useful for an automated process or assembly line wherein objects such as, but not limited to, cans or shells are moved through the fluid dispensing system.

A disadvantage of such a system is that, when the flow stream of the compound is interrupted by the needle, the compound stretches then breaks. When it breaks, small pieces of compound are flung around the needle and nozzle. These particles eventually settle on the nozzle or other parts of the spray gun. That is, during application of the liquid, the air flowing about the shells and the machine carrying the shells, as well as the flow stream itself, creates a fluid flow pattern in the air disposed about the flow stream. The flow pattern of the air typically includes a vortex, i.e. air flow that rotates back toward the nozzle, and/or may be turbulent. The final portion of the stream of liquid, i.e. the last liquid out of the spray gun when the spray gun closes, breaks into particles and some of those particles are carried by the vortex or turbulent airflow back to the nozzle or onto other parts of the spray gun or nearby machine components. Hereinafter, and as used herein, the final portion of the stream of liquid that breaks into particles is identified as "snapback particles." Over time, the snapback particles build up on the nozzle and other machine components and requires removal. Removal of the snapback particles requires the operation of the spray gun to be halted resulting in down time for the spray gun and machines.

There is, therefore, a need for a system to direct the snapback particles to the desired substrate. There is a further need for such a system to be compatible with existing fluid dispensing systems.

SUMMARY OF THE INVENTION

These needs, and others, are met by at least one embodiment of this invention which provides an air halo assembly for a spray gun assembly is provided. The spray gun assembly includes a fluid supply assembly, an air supply assembly, and an air halo nozzle assembly. The air halo nozzle assembly includes a liquid nozzle assembly and an air halo assembly. The fluid supply assembly is coupled to, and is in fluid communication with, the liquid nozzle assembly. The air halo nozzle assembly is structured to produce a liquid flow stream having a longitudinal axis. The air halo assembly includes a body. The air halo body defines a passage. The air halo assembly body passage includes an inlet and air halo outlet. The air halo assembly body passage inlet is structured to be in fluid communication with the air supply assembly.

It is noted that the shape and configuration of the air halo assembly, and elements thereof, solve the problems stated above.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
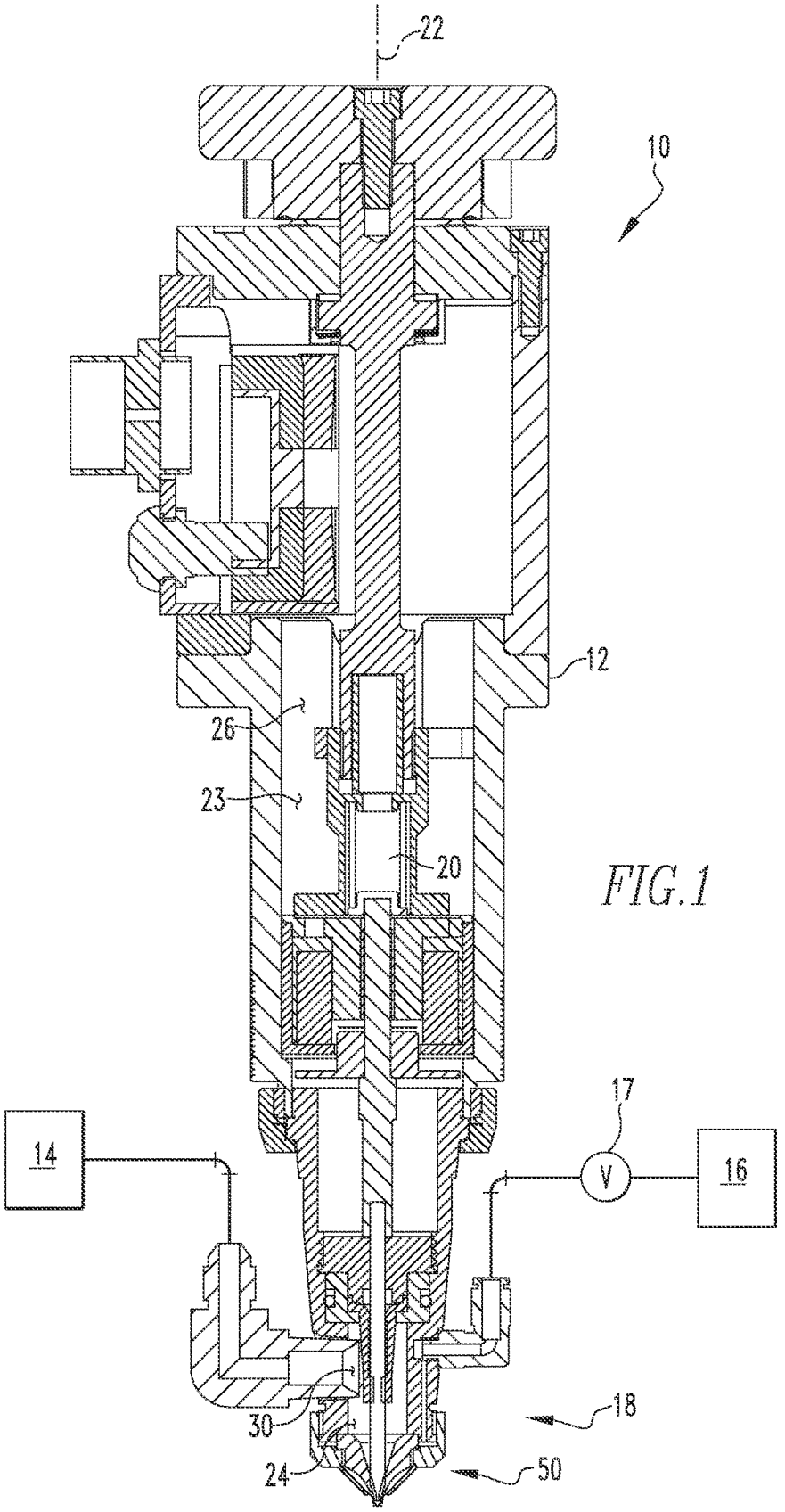
FIG. 1 is a cross-sectional side view of a spray gun.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, a "coupling assembly" includes two or more couplings or coupling components. The components of a coupling or coupling assembly are generally not part of the same element or construct. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, a "fastener" is a type of coupling component which is a separate component structured to couple two or more elements. Thus, for example, a bolt is a "fastener" but a tongue-and-groove coupling is not a "fastener." That is, the tongue-and-groove elements are part of the elements being coupled and are not a separate component.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. It is noted that moving parts, such as but not limited to circuit breaker contacts, are "directly coupled" when in one position, e.g., the closed, second position, but are not "directly coupled" when in the open, first position. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof.

As used herein, the phrase "removably coupled" means that one component is coupled with another component in an essentially temporary manner. That is, the two components are coupled in such a way that the joining or separation of the components is easy and would not damage the components. For example, two components secured to each other with a limited number of readily accessible fasteners are "removably coupled" whereas two components that are welded together or joined by difficult to access fasteners are not "removably coupled." A "difficult to access fastener" is one that requires the removal of one or more other components prior to accessing the fastener wherein the "other component" is not an access device such as, but not limited to, a door.

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the element defining the opening and/or the component inserted into the opening are made from a deformable or compressible material, the opening may even be slightly smaller than the component being inserted into the opening. With regard to surfaces, shapes, and lines, two, or more, "corresponding" surfaces, shapes, or lines have generally the same size, shape, and contours.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein. "structured to [verb]" recites structure and not function.

As used herein, and in the phrase "[x] moves between a first position and a second position corresponding to [y] first and second positions." wherein "[x]" and "[y]" are elements or assemblies, the word "correspond" means that when element [x] is in the first position, element [y] is in the first position, and, when element [x] is in the second position, element [y] is in the second position. It is noted that "correspond" relates to the final positions and does not mean the elements must move at the same rate or simultaneously. That is, for example, a hubcap and the wheel to which it is attached rotate in a corresponding manner. Conversely, a spring biased latched member and a latch release move at different rates. That is, as an example, a latch release moves between a first position, wherein the latched member is not released, and a second position, wherein the latched member is released. The spring-biased latched member moves between a first latched position and a second released position. The latch release may move slowly between positions and, until the release is in the second position, the latched member remains in the first position. But, as soon as the latch release reaches the second position, the latched member is released and quickly moves to the second position. Thus, as stated above, "corresponding" positions mean that the elements are in the identified first positions at the same time, and, in the identified second positions at the same time.

As used herein, the statement that two or more parts or components "engage" one another shall mean that the elements exert a force or bias against one another either directly or through one or more intermediate elements or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A either engages element B while in element A first position.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "coupled" to the screw. If an axial force is applied to the screwdriver, the screwdriver is pressed against the screw and "engages" the screw; however, when a rotational force is applied to the screwdriver, the screwdriver "operatively engages" the screw and causes the screw to rotate.

As used herein, the word "unitary" means a component that is created as a single piece or unit. That is, a component that includes pieces that are created separately and then coupled together as a unit is not a "unitary" component or body.

As used herein, the term "number" shall mean one or an integer greater than one (i.e., a plurality).

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, in the phrase "[x] moves between its first position and second position," or, "[y] is structured to move [x] between its first position and second position," "[x]" is the name of an element or assembly. Further, when [x] is an element or assembly that moves between a number of positions, the pronoun "its" means "[x]," i.e. the named element or assembly that precedes the pronoun "its."

As used herein, "generally curvilinear" includes elements having multiple curved portions, combinations of curved portions and planar portions, and a plurality of planar portions or segments disposed at angles relative to each other thereby forming a curve.

As used herein, a "valve" includes at least a valve seat and valve member. The valve seat may be in a passage. The valve member moves between a first position, wherein the valve member engages the valve seat, and a second position, wherein the valve member is spaced from the valve seat. When a valve member engages a valve seat no fluid, or substantially no fluid, may pass the valve member.

As used herein, an "air halo outlet" is an outlet, or exhaust, in a construct through which a gas moves that creates a defined, elongated gas flow that extends about, i.e. around, and immediately adjacent a liquid flow stream. In this configuration, and as used herein, the "air halo outlet" substantially contains the liquid flow stream within the defined, elongated gas flow. An outlet, or exhaust, that creates a defined, elongated gas flow that extends about a solid construct is not an "air halo outlet" in that a solid construct is self-containing and is not contained by the defined, elongated gas flow. In an exemplary embodiment, discussed herein, an "air halo outlet" creates a hollow column of air that extends about a spray from a fluid nozzle. As used herein, a "defined, elongated gas flow" means a flow pattern in a gas that is substantially uniform and not turbulent and wherein the defined pattern is maintained over a length of at least 0.2 inch. Further, the defined, elongated gas flow created by an "air halo outlet" must be intentional and be able to exist in a non-controlled, industrial environment, such as, but not limited to, an environment wherein cans have an adhesive applied thereto. Thus, an annulus, or ring-shaped outlet, that is ostensibly capable of creating a defined, elongated gas flow in a non-industrial environment is not an "air halo outlet" as used herein. Further, a construct that creates a planar air curtain cannot be an "air halo outlet" because such a defined gas flow cannot extend "about" a liquid flow stream. That is, a planar gas flow cannot encircle a liquid spray. Further, an air curtain is structured to resist movement of particles across the air curtain and is not structured to substantially contain the liquid flow stream within the defined, elongated gas flow. It is specifically noted that as defined, an "air halo outlet" is an outlet, or exhaust, through which a gas moves. That is, a construct that sprays a liquid or particles suspended in a gas flow cannot be an "air halo outlet" as defined herein.

As shown in FIG. 1, a spray gun 10 includes a housing assembly 12, a fluid supply assembly 14, an air supply assembly 16, a nozzle assembly 18 and an operating mechanism 20, some elements shown schematically. As used herein, "air" refers to any gas or mixture of gases; it is understood that in an exemplary embodiment, the gas will be the gas available in the environment wherein the spray gun 10 is located. In an exemplary embodiment, the spray gun housing assembly 12 is elongated and has a longitudinal axis 22. In an exemplary embodiment, the spray gun housing assembly defines an enclosed space 23 including a fluid chamber 24 and an operating mechanism chamber 26. The fluid chamber 24 and the operating mechanism chamber 26 are sealed from each other so that no fluid may pass from the fluid chamber 24 to the operating mechanism chamber 26. The fluid chamber 24 has a fluid inlet 30 and, in an exemplary embodiment, an excess fluid outlet (not shown). Further, the nozzle assembly 18 is disposed in, and is in fluid communication with, the fluid chamber 24. The fluid inlet 30 and the excess fluid outlet are each coupled to, and in fluid communication with, the fluid supply assembly 14. The fluid supply assembly 14 delivers a liquid product to the fluid chamber 24 via the fluid inlet 30. If there is a need for recirculation of the liquid, the excess liquid product exits the fluid chamber 24 via the excess fluid outlet. In an exemplary embodiment, the fluid supply assembly 14 delivers a liquid adhesive.

Figure 3:
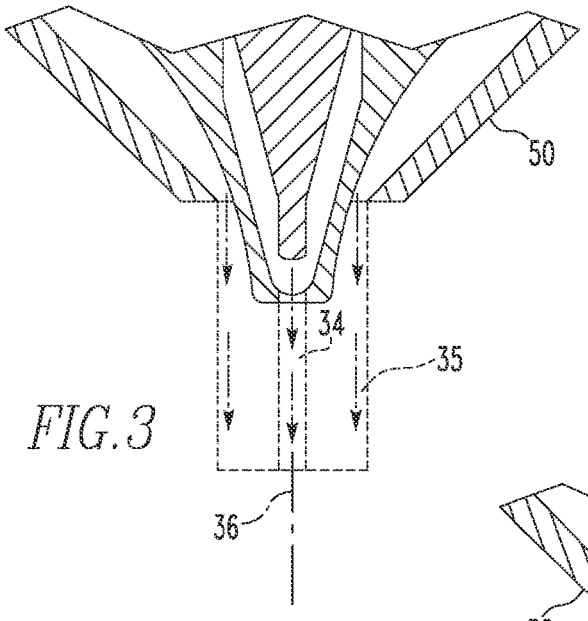
FIG. 3 is a side view of a tubular column of air.
Figure 4:
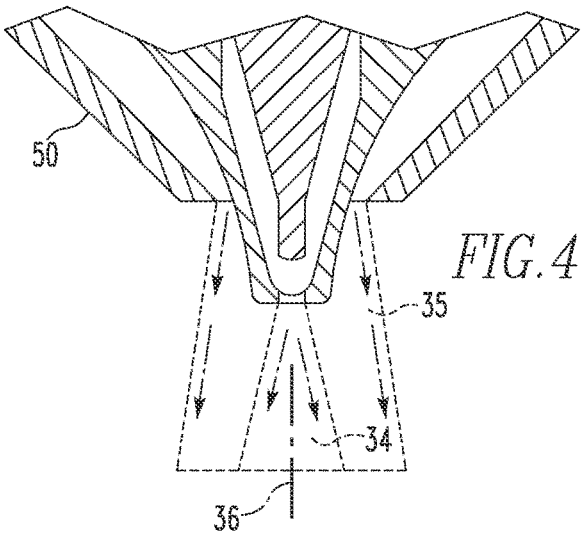
FIG. 4 is a side view of a tapered column of air.
Figure 5:
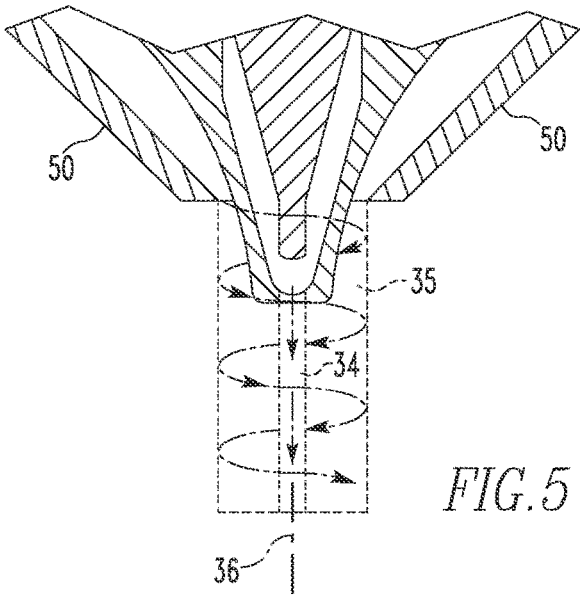
FIG. 5 is a side view of an axial vortex of air.

Generally, the nozzle assembly 18 defines a liquid passage 80 that is in fluid communication with the fluid chamber 24 and the space outside of the spray gun housing assembly 12. That is, the nozzle assembly liquid passage 80 terminates at an opening 86, which is a liquid outlet 88. In this configuration, the liquid product may flow into the fluid chamber 24 via the fluid inlet 30. The liquid product, or a portion thereof, may pass through the nozzle assembly 18 and be applied to a work piece (not shown). As is known, the liquid product is supplied at a sufficient pressure so that the liquid product emerges from the nozzle assembly 18 as a liquid flow stream 34 (FIGS. 3-5), i.e. a stream or a spray. In an exemplary embodiment, the liquid flow stream 34 is generally elongated and has a longitudinal axis 36 (FIGS. 3-5). In an exemplary embodiment, the spray gun housing assembly longitudinal axis 22 and the flow stream longitudinal axis 36 are substantially aligned and overlap with each other, i.e. the spray gun housing assembly longitudinal axis 22 and the flow stream longitudinal axis 36 are substantially the same.

Figure 2:
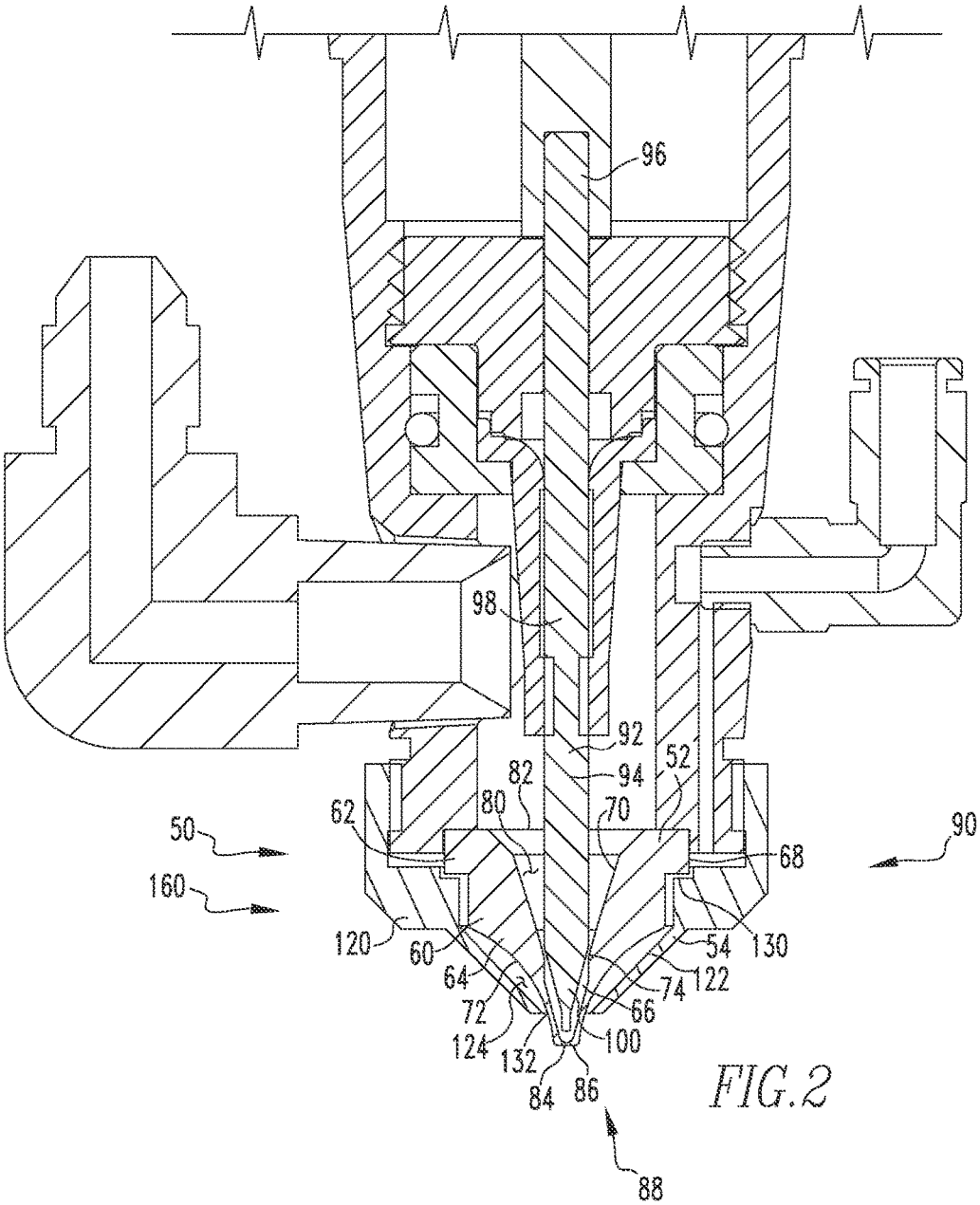
FIG. 2 is a detail cross-sectional side view of an air halo nozzle assembly.

As shown in FIG. 2, the nozzle assembly 18 is, in an exemplary embodiment, an air halo nozzle assembly 50. The air halo nozzle assembly 50 includes a liquid nozzle assembly 52 and an air halo assembly 54. While the nozzle assembly 18, and the elements thereof, may have any cross-sectional shape, in an exemplary embodiment, the nozzle assembly 18, and the elements thereof, are generally cylindrical, conical, or toroidal. That is, the nozzle assembly 18, and the elements thereof, generally have a conical cross-sectional shape centered about a longitudinal axis which, in an exemplary embodiment, is also the spray gun housing assembly longitudinal axis 22.

The liquid nozzle assembly 52 includes a generally tapered body 60 and a valve assembly 90. That is, the liquid nozzle assembly body 60 includes a collar portion 62 and a tapered portion 64. The liquid nozzle assembly body collar portion 62 is generally a rectangular torus defining a central passage 66 having an outer radial surface 68. The liquid nozzle assembly body collar portion radial surface 68, in an exemplary embodiment, extends generally parallel to the spray gun housing assembly longitudinal axis 22. The liquid nozzle assembly body tapered portion 64 is, in an exemplary embodiment, a hyperbolic torus.

That is, in an exemplary embodiment, the liquid nozzle assembly body tapered portion 64 includes a generally tapered inner surface 70 and a generally hyperbolic outer surface 72. In other embodiments, not shown, the liquid nozzle assembly body tapered portion inner surface 70 and the liquid nozzle assembly body tapered portion outer surface 72 have other contours including, but not limited to, generally conical, generally parabolic, or generally curvilinear, as well as a generally hyperbolic inner surface. Stated alternately, the liquid nozzle assembly body 60 is one of a conical body (not shown), a parabolic body (not shown), a hyperbolic body 60, or a curvilinear body (not shown). That is, the name of, i.e. the adjective used to describe, the liquid nozzle assembly body 60 refers to the general shape of the liquid nozzle assembly body tapered portion outer surface 72.

The liquid nozzle assembly body tapered portion inner surface 70 defines a liquid passage 80, hereinafter "liquid nozzle assembly body passage" 80. The liquid nozzle assembly body passage 80 includes a proximal end 82 and a distal end 84. The liquid nozzle assembly body passage proximal end 82 is in fluid communication with the fluid chamber 24. The liquid nozzle assembly body passage distal end 84 is an opening 86 in the liquid nozzle assembly body 60. The liquid nozzle assembly body passage opening 86 is a liquid outlet 88, as discussed below.

The liquid nozzle assembly body tapered portion inner surface 70, hereinafter, "liquid nozzle assembly body inner surface" 70 defines a valve member seat 74, hereinafter the "liquid nozzle assembly valve seat" 74. In an exemplary embodiment, only a distal portion, i.e. the portion spaced from the liquid nozzle assembly body collar portion 62, of the liquid nozzle assembly body inner surface 70 defines the valve seat 74.

In one embodiment, discussed below, the air halo assembly 54 is movably coupled to the spray gun housing assembly 12 and is structured to act as a valve member. That is, the halo assembly body inner surface 122 moves over, i.e. longitudinally relative to, the liquid nozzle assembly body tapered portion outer surface 72, hereinafter "liquid nozzle assembly body outer surface 72" is structured to seal thereagainst. Thus, the air halo assembly 54 and/or the liquid nozzle assembly body 60 is structured to be a valve member, and in an exemplary embodiment (not shown), an air halo valve member, as discussed below.

The liquid nozzle assembly valve assembly 90 includes an elongated valve member 92. The liquid nozzle assembly valve assembly valve member 92 is also a part of the operating mechanism 20. The liquid nozzle assembly valve assembly valve member 92 includes an elongated, generally tapered body 94. The liquid nozzle assembly valve assembly valve member body 94 includes a proximal end 96, a medial portion, 98, and a distal end 100. The liquid nozzle assembly valve assembly valve member body proximal end 96 is coupled, directly coupled, removably coupled or fixed to the operating mechanism 20. The liquid nozzle assembly valve assembly valve member body medial portion, 98 is generally cylindrical. In an exemplary embodiment, the liquid nozzle assembly valve assembly valve member body distal end 100 is generally tapered.

The air halo assembly 54 includes a generally toroidal body 120 including an inner surface 122 that defines a passage 124. The air halo assembly body passage 124 includes a proximal (closer to the operating mechanism 20) inlet 130 and a distal (further from the operating mechanism 20) air halo outlet 132. The air halo assembly body passage inlet 130 is structured to be in fluid communication with the air supply assembly 16. The air halo assembly body passage inlet 130 has a first cross-sectional area. The air halo assembly body passage outlet 132 (hereinafter, "air halo outlet" 132) has a second cross-sectional area. The first cross-sectional area is greater than the second cross-sectional area. In this configuration, air passing through the air halo assembly body passage 124 will increase its velocity.

Further, the air halo assembly body passage 124 is one of a generally conical passage (shown), a generally parabolic passage (not shown), a generally hyperbolic (not shown), or a generally curvilinear passage (not shown). That is, in one embodiment, the halo assembly body inner surface 122 is generally tapered from the air halo assembly body passage inlet 130 to the air halo outlet 132 thereby forming a generally conical passage. In another embodiment, not shown, the halo assembly body inner surface 122 defines a generally parabolic curve from the air halo assembly body passage inlet 130 to the air halo outlet 132 thereby forming a generally parabolic passage. In another embodiment, not shown, the halo assembly body inner surface 122 is generally curvilinear and narrows from the air halo assembly body passage inlet 130 to the air halo outlet 132 thereby forming a generally curvilinear passage. It is noted that the shape and/or contour of the air halo assembly body passage 124 creates a defined, elongated gas flow air which solves the problems stated above.

In another embodiment, not shown, the halo assembly body inner surface 122 defines a generally hyperbolic curve from the air halo assembly body passage inlet 130 to the air halo outlet 132 thereby forming a generally hyperbolic passage. Further, in another exemplary embodiment, not shown, the curvature of the generally hyperbolic air halo assembly body passage 124 generally corresponds to the curvature of the generally hyperbolic liquid nozzle assembly body outer surface 72. It is understood that, in this exemplary embodiment, the contour of the air halo assembly body passage 124 generally corresponds to the contour of the liquid nozzle assembly body tapered portion outer surface 72. In this configuration, the halo assembly body inner surface 122, or a portion thereof (not shown), is an air halo valve seat. The air halo valve seat is structured to be engaged by an air halo valve member (not shown). In this exemplary embodiment, the air halo assembly body 120 is the air halo valve member.

The spray gun 10 with an air halo nozzle assembly 50 is assembled as follows. The operating mechanism 20 is substantially disposed within the operating mechanism chamber 26. A portion of the operating mechanism 20, such as but not limited to the liquid nozzle assembly valve assembly valve member 92 extends into the fluid chamber 24. The operating mechanism 20 is structured to move the liquid nozzle assembly valve assembly valve member 92 between an extended, first position, wherein the liquid nozzle assembly valve assembly valve member 92 is closer to the operating mechanism chamber 26, and a retracted, second position, wherein the liquid nozzle assembly valve assembly valve member 92 is further from the operating mechanism chamber 26.

The fluid supply assembly 14 is coupled to, and is in fluid communication with, the fluid chamber 24. Thus, the liquid product is provided to the fluid chamber 24. The air halo nozzle assembly 50 is substantially disposed in the fluid chamber 24 as well. In this configuration, the liquid nozzle assembly 52, and as shown the liquid nozzle assembly body passage 80, is coupled to, and is in fluid communication with, the fluid chamber 24 and therefore the fluid supply assembly 14 as well. Thus, the liquid product is provided to the fluid chamber liquid nozzle assembly 52. Further, the liquid nozzle assembly valve assembly valve member 92 is disposed in the liquid nozzle assembly body passage 80. In this configuration, the operating mechanism 20 moves the liquid nozzle assembly valve assembly valve member 92 between a closed, first position, wherein the liquid nozzle assembly valve assembly valve member 92 engages the liquid nozzle assembly valve seat 74, and an open, second position, wherein the liquid nozzle assembly valve assembly valve member 92 is spaced from the liquid nozzle assembly valve seat 74. Thus, the liquid nozzle assembly valve assembly valve member 92 and the liquid nozzle assembly valve seat 74 form a liquid valve 160. It is understood that the liquid nozzle assembly valve assembly valve member 92 may also be placed in between the first and second positions, i.e. the air halo nozzle assembly 50 may be partially open.

Both the liquid nozzle assembly body 60 and the air halo assembly body 120 are coupled, directly coupled, removably coupled, or fixed to the spray gun housing assembly 12 at the fluid chamber 24. In an exemplary embodiment, both the liquid nozzle assembly body 60 and the air halo assembly body 120 are fixed to the spray gun housing assembly 12. That is, neither the liquid nozzle assembly body 60 or the air halo assembly body 120 move relative to the spray gun housing assembly 12. In this embodiment, the air supply assembly 16 may include a valve 17, shown schematically, structured to control the flow of air through the air halo assembly 54. In this embodiment, the air halo assembly body 120 is disposed about, i.e. encircling, the liquid nozzle assembly body 60. That is, the air halo outlet 132 is disposed about the liquid outlet 88. Further, the air halo assembly body passage air halo outlet 132 and the nozzle assembly housing assembly body liquid outlet 88 are disposed in one of an aligned configuration or an offset configuration. That is, as used herein, when the air halo assembly body passage air halo outlet 132 and the nozzle assembly housing assembly body liquid outlet 88 are located immediately adjacent each other, or in the same general plane, the outlets 132, 88 are in an "aligned configuration." Conversely, as used herein, when the air halo assembly body passage air halo outlet 132 and the nozzle assembly housing assembly body liquid outlet 88 are spaced from each other in a longitudinal direction, i.e. spaced along the spray gun housing assembly longitudinal axis 22, the outlets 132, 88 are in an "offset configuration."

In an exemplary embodiment, not shown, the outlets 132, 88 are offset and the liquid nozzle assembly body 60 extends out of the air halo outlet 132. In this configuration, the air halo outlet 132 is structured to create a defined, elongated gas flow over both the liquid nozzle assembly body 60 and the liquid flow stream 34. Thus, while the defined, elongated gas flow over the liquid nozzle assembly body 60 does not establish the gas outlet as an "air halo outlet" under the definition above, the continued defined, elongated gas flow over the liquid flow stream 34 establishes the gas outlet as an "air halo outlet" under the definition above, In operation, the air supply assembly valve 17 is opened to create a defined, elongated gas flow. The liquid nozzle assembly valve assembly valve member 92 is then moved from its first position to its second position, thereby initiating a flow stream of liquid product having an air halo thereabout. The liquid nozzle assembly valve assembly valve member 92 is moved between the first and second positions intermittently as work pieces move under the spray gun 10. In an exemplary embodiment, the air supply assembly valve 17 is maintained in an open configuration as the liquid nozzle assembly valve assembly valve member 92 moves between the first and second positions. Stated alternately, the liquid nozzle assembly 52 is structured to, and does, open and close intermittently and the air halo assembly 54 is structured to, and does, remain open generally constantly during the operation of the spray gun 10. That is, as used herein, an "open" liquid nozzle assembly 52 and/or an open air halo assembly 54 means that a fluid is flowing through the identified assembly. Conversely, a "closed" liquid nozzle assembly 52 and/or an open air halo assembly 54 means that no fluid is flowing through the identified assembly. Further, "during the operation of said spray gun," as used herein, means the period of time during which the spray gun 10 is used to apply a liquid product to a plurality of work pieces.

In another exemplary embodiment, not shown, the air halo assembly body 120 is movably disposed about the liquid nozzle assembly body 60. In this configuration, the air halo assembly body 120 is an air halo valve member. That is, the air halo assembly body 120, i.e. the air halo valve member, is structured to move between a closed, first position, wherein the air halo valve member engages an air halo valve seat, and an open, second position, wherein the air halo valve member is spaced from the air halo valve seat. Thus, the air halo valve member and the air halo valve seat form an air halo valve. Further, in this configuration, the air halo valve is disposed concentrically about the liquid valve 160.

In this configuration, when the liquid nozzle assembly valve assembly valve member 92 and the air halo valve member each move from a respective second position to their first position, the liquid nozzle assembly valve assembly valve member 92 and the air halo valve member are structured to move in a broadening sequence. As used herein, and in conjunction with concentric valves, a "broadening sequence" means the inner valve is actuated and or reaches a final position, before the outer valve. Thus, when the inner liquid valve 160 and the outer air halo valve are closing in a broadening sequence, the inner liquid valve 160 closes, i.e. moves into the first position, before the air halo valve closes, i.e. moves into the first position.

In either embodiment, the air halo nozzle assembly 50 is structured to create an elongated liquid flow stream 34, noted above, and a defined, elongated gas flow 35 disposed thereabout. That is, the defined, elongated gas flow 35 (FIGS. 3-5) is disposed about, i.e. encircling, the liquid flow stream 34. In an exemplary embodiment, shown in FIGS. 3 and 5, the liquid flow stream 34 is generally cylindrical (until it comes into contact with a work piece (not shown)). In an alternate embodiment, shown in FIG. 4, the liquid flow stream 34 widens slightly as it moves away from the air halo nozzle assembly 50. The air halo assembly 54 is structured to produce one of a tubular column of air, a tapered column of air, or an axial vortex of air. As shown in FIG. 3, a tubular column of air is a generally cylindrical tubular flow pattern wherein the air moves substantially linearly away from the air halo assembly 54. As shown in FIG. 4, a tapered column of air is a generally widening flow pattern wherein the air moves substantially linearly and outwardly away from the air halo assembly 54. As shown in FIG. 5, an axial vortex of air is a generally cylindrical tubular flow pattern, or a widening cylindrical tubular flow pattern (not shown), wherein the air moves in a rotating pattern as it moves away from the air halo assembly 54. Each of the tubular column of air, a tapered column of air, or an axial vortex of air are, as used herein, "defined, elongated gas flows."

In operation, the liquid valve 160 closes, i.e. moves into the first position, before the air halo valve closes, i.e. moves into the first position. Thus, the liquid flow stream 34 ceases before the defined, elongated gas flow 35. As the liquid flow stream 34 ceases snapback particles are created. In this configuration, however, the defined, elongated gas flow 35 is disposed about the snapback particles. The defined, elongated gas flow 35 substantially prevents the snapback particles from traveling in a random direction. That is, the defined, elongated gas flow 35 substantially directs the snapback particles to the work piece, thereby solving the problems stated above.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An air halo assembly for a spray gun assembly, said spray gun assembly including a fluid supply assembly, an air supply assembly, and a liquid nozzle assembly, said fluid supply assembly coupled to, and in fluid communication with said nozzle assembly said liquid nozzle assembly including a liquid outlet, said liquid nozzle assembly structured to produce a liquid flow stream having a longitudinal axis, said liquid flow stream configured to be applied to a work piece, and wherein said liquid nozzle assembly produces snapback particles, said air halo assembly comprising:

a body defining a passage;

said air halo assembly body passage including an inlet and air halo outlet;

said air halo assembly body passage inlet is structured to be in fluid communication with said air supply assembly;

wherein said air halo outlet creates a defined, elongated gas flow that extends about and immediately adjacent said liquid flow stream; and wherein said elongated gas flow is disposed about said snapback particles and configured to substantially directs said snapback particles to said work piece.

2. The air halo assembly of claim 1 wherein:

said air halo assembly body passage is one of a conical passage, a parabolic passage, a hyperbolic, or a curvilinear passage;

said air halo assembly body passage inlet having a first cross-sectional area;

said air halo outlet having a second cross-sectional area; and wherein said first cross-sectional area is greater than said second cross-sectional area.

3. The air halo assembly of claim 1 wherein said air halo outlet is structured to produce one of a tubular column of air, a tapered column of air, or an axial vortex of air.

4. The air halo assembly of claim 1 wherein said nozzle assembly includes a body and wherein said air halo assembly body is disposed about said nozzle assembly body.

5. The air halo assembly of claim 1 wherein said liquid flow stream is generally cylindrical and wherein said air halo outlet is structured to produce a tubular column of air.

6. An air halo nozzle assembly for a spray gun assembly, the spray gun assembly including a fluid supply assembly and an air supply assembly, said air halo nozzle assembly comprising:

a liquid nozzle assembly including a body and a valve assembly;

said liquid nozzle assembly body defining a passage and a liquid outlet, said liquid nozzle assembly body passage in fluid communication with said nozzle assembly body liquid outlet;

said liquid nozzle assembly body passage structured to be coupled to, and in fluid communication with, said fluid supply assembly;

wherein said liquid nozzle assembly is structured to produce a liquid flow stream from said liquid nozzle assembly body liquid outlet having a longitudinal axis said liquid flow stream configured to be applied to a work piece;

wherein said liquid nozzle assembly produces snapback particles;

an air halo assembly including a housing assembly;

said air halo assembly housing assembly including a body;

said air halo assembly body defining a passage;

said air halo assembly body passage including an inlet and an air halo outlet;

said air halo assembly body passage air halo outlet disposed about said nozzle assembly housing assembly body liquid outlet;

said air halo assembly body passage inlet is structured to be in fluid communication with said air supply assembly;

wherein said air halo outlet creates a defined, elongated gas flow that extends about and immediately adjacent said liquid flow stream; and wherein said elongated gas flow is disposed about said snapback particles and configured to substantially direct said snapback particles to said work piece.

7. The air halo nozzle assembly of claim 6 wherein:

said air halo assembly body passage is one of a conical passage, a parabolic passage, a hyperbolic, or a curvilinear passage;

said air halo assembly body passage inlet having a first cross-sectional area;

said air halo outlet having a second cross-sectional area; and wherein said first cross-sectional area is greater than said second cross-sectional area.

8. The air halo nozzle assembly of claim 6 wherein said air halo outlet is structured to produce one of a tubular column of air, a tapered column of air, or an axial vortex of air.

9. The air halo nozzle assembly of claim 6 wherein said liquid flow stream is generally cylindrical and wherein said air halo outlet is structured to produce a tubular column of air.

10. The air halo nozzle assembly of claim 9 wherein:

said liquid nozzle assembly opens and closes intermittently during the operation of said spray gun; and said air halo assembly remains open constantly during the operation of said spray gun.

11. The air halo nozzle assembly of claim 6 wherein said air halo assembly body passage air halo outlet and said nozzle assembly body liquid outlet are disposed in one of an aligned configuration or an offset configuration.

12. A spray gun assembly comprising:

a housing assembly;

an operating mechanism disposed in said housing assembly;

an air halo nozzle assembly including a liquid nozzle assembly and an air halo assembly, said air halo nozzle assembly substantially disposed in said housing assembly;

a fluid supply assembly coupled to, and in fluid communication with, said liquid nozzle assembly;

an air supply assembly, coupled to, and in fluid communication with, said air halo assembly;

said liquid nozzle assembly including a body and a valve assembly;

said liquid nozzle assembly body defining a passage and a liquid outlet, said liquid nozzle assembly body passage in fluid communication with said nozzle assembly body liquid outlet;

said liquid nozzle assembly body passage structured to be coupled to, and in fluid communication with, said fluid supply assembly;

wherein said liquid nozzle assembly is structured to produce a liquid flow stream from said liquid nozzle assembly body liquid outlet having a longitudinal axis, said liquid flow stream configured to be applied to a work piece;

wherein said liquid nozzle assembly produces snapback particles;

said air halo assembly including a housing assembly;

said air halo assembly housing assembly including a body;

said air halo assembly body defining a passage;

said air halo assembly body passage including an inlet and outlet;

said air halo outlet disposed about said nozzle assembly body liquid outlet;

said air halo assembly body passage inlet is structured to be in fluid communication with said air supply assembly;

wherein said air halo outlet creates a defined, elongated gas flow that extends about and immediately adjacent said liquid flow stream; and wherein said elongated gas flow is disposed about said snapback particles and configured to substantially direct said snapback particles to said work piece.

13. The spray gun assembly of claim 12 wherein:

said air halo assembly body passage is one of a conical passage, a parabolic passage, a hyperbolic, or a curvilinear passage;

said air halo assembly body passage inlet having a first cross-sectional area;

said air halo outlet having a second cross-sectional area; and wherein said first cross-sectional area is greater than said second cross-sectional area.

14. The spray gun assembly of claim 12 wherein said air halo outlet is structured to produce one of a tubular column of air, a tapered column of air, or an axial vortex of air.

15. The spray gun assembly of claim 12 wherein said air halo assembly body is disposed about said nozzle assembly housing assembly.

16. The spray gun assembly of claim 12 wherein said liquid flow stream is generally cylindrical and wherein said air halo outlet is structured to produce a tubular column of air.

17. The spray gun assembly of claim 12 wherein:

said liquid nozzle assembly opens and closes intermittently during the operation of said spray gun; and said air halo assembly remains open constantly during the operation of said spray gun.

18. The spray gun assembly of claim 12 wherein said air halo assembly body passage air halo outlet and said nozzle assembly body liquid outlet are disposed in one of an aligned configuration or an offset configuration.

* * * * *